United States Patent [19]

Vidal

[11] 4,418,432

[45] Dec. 6, 1983

[54] DRAIN FILTER HAVING FILAMENTARY SURFACE IRREGULARITIES TO ENTANGLE HAIR AND DEBRIS

[76] Inventor: Stella M. Vidal, 175 SW. 14th St., Apt. 3, Miami, Fla. 33130

[21] Appl. No.: 296,293

[22] Filed: Aug. 26, 1981

[51] Int. Cl.[3] ..... A47K 1/14; E03C 1/26; E03C 1/264

[52] U.S. Cl. ..... 4/286; 4/292; 4/293; 210/163; 210/166; 210/505; 428/35; 428/36; 428/40; 428/65; 428/66; 428/85; 428/89; 428/343

[58] Field of Search ..... 210/163, 166, 505; 4/286, 292, 293; 428/36, 65, 66, 35, 40, 85, 89, 343

[56] References Cited

U.S. PATENT DOCUMENTS

| | | | |
|---|---|---|---|
| 1,203,530 | 10/1916 | Gessler | 4/286 |
| 1,935,128 | 11/1933 | Pullman | 4/286 |
| 1,996,279 | 4/1935 | Dillon | 4/292 |
| 2,506,669 | 5/1950 | Henacker | 4/292 |
| 3,402,407 | 9/1968 | Andrews | 4/293 |
| 3,742,524 | 7/1973 | Ballentine | 4/286 |
| 3,788,485 | 1/1974 | Bruning | 4/292 |
| 3,972,078 | 8/1976 | Maki | 4/292 |
| 4,049,551 | 9/1977 | Otzen | 210/163 |
| 4,134,162 | 1/1979 | Sharland et al. | 4/292 |

FOREIGN PATENT DOCUMENTS

| | | | |
|---|---|---|---|
| 23036 | 1/1936 | Australia | 4/286 |
| 2230198 | 1/1974 | Fed. Rep. of Germany | 4/286 |
| 2843306 | 4/1979 | Fed. Rep. of Germany | 4/286 |
| 7776 | of 1894 | United Kingdom | 4/286 |
| 105535 | 4/1917 | United Kingdom | 4/286 |

*Primary Examiner*—James C. Cannon

[57] ABSTRACT

A new article of flexible and springy though rigid enough water impervious material provided with spikes or bristles or open web of crinkled filaments or rough indented openings to be installed around any conventional stopper for preventing hair, hairpins, or any other object carried away with the water flow during the taking of showers or washings or the like, from entering and clogging the drainpipes of bathtubs, lavatories and the like, through an entangling action carried out by said spikes or bristles or web or rough indented openings, and said article having a body which is shaped to be adapted to surround the lifted conventional pop-up stoppers or the like, of the drain control systems of bathtubs, lavatories and the like, and which may take any of several preferred cross section forms, such as for example, a hollow core elongated semicylindrical form which is integral with a flat imperforate lower portion or base, providing several preferred undersurfaces or a hollow core cylindrical form, or a vertical strip-like form, or a cup-like form, or a stepped strip-like form, and said forms being constituted by a net-like structure with a plurality of openings, which in the three last mentioned cross section forms, is integral with imperforate zones and with an outwardly directed surrounding flexible flat base having a central hole defined therein and the base providing several preferred undersurfaces.

65 Claims, 25 Drawing Figures

DRAIN FILTER HAVING FILAMENTARY SURFACE IRREGULARITIES TO ENTANGLE HAIR AND DEBRIS

BACKGROUND OF THE INVENTION

The present invention relates to devices for the prevention of clogging of drainpipes of bathtubs, lavatories and the like, particularly due to the accumulation of hair therein. More particularly, the present invention relates to a new article which prevents hair, hairpins or any other object carried away with the water flow during the taking of showers or washings or the like, from entering and clogging the drainpipes of bathtubs, lavatories and the like, by means of an entangling action carried out by flexible spikes or bristles or by an open lofty integrated web of continuous crinkled filaments or by rough indented openings provided by the article, in conjunction with a blocking action carried out by the shape of the article, which is shaped to be adapted to surround entirely the lifted conventional vertically extensible drain stopper or the like of the drain control systems of bathtubs, lavatories and the like, and both said actions being exerted upon the fallen hair, hairpins or any other object carried away with the water flow, thereby preventing said hair, hairpins or any other object from entering and clogging the drainpipes, while the net-like structure and/or the open web, which constitutes the body of the article, allows through suitably dimensioned openings the free flow of running water with out hair into the drain pipe opening, when the article is installed around any conventional stopper.

The main cause of clogging of drainpipes of bathtubs, shower stalls, lavatories and the like, is the accumulation of hair therein. The clogging of drainpipes of bathtubs, shower stalls, lavatories and the like, due to the accumulation of hair therein during the taking of showers or washings or the like, is a problem that has not yet been property solved by anyone of the usual ways of overcoming this problem which consist in using unclogging chemical products, which represent a health hazard in the home, or using a plunger or a drain auger, or a snake, or calling a plumber. This disadvantages of these approaches to the problem are that they do not prevent the clogging itself by eliminating its cause, which is the entrance of hair into the said drainpipes, and only attempt to solve it after it has occurred, often even without good results, and thus drainpipes are regularly clogged because of hair accumulation therein. Other disadvantages of the use of these apparent "solutions" are that they represent a nuisance, an additional expense and can be damaging to the piping system in the long run, and above all, clogging will keep recurring.

Heretofore, a major disadvantage of the existing strainers which claim to end the clogging problem of drainpipes of bathtubs, shower stalls, lavatories and the like, is that they do not actually prevent said fallen hair from entering and clogging the drainpipes because they do not exert a holding action upon the hair which slides into the openings of said strainers, thus entering and clogging the drainpipes during the taking of showers or washings, or the like. In addition, the existing drain covers provided with a screen which claim to prevent hair from clogging the drainpipes with the screen, actually prevent the free flow of draining water into the drainpipes due to the smallness of the openings of the screen, which intend to impede the passage of hair and foreign matter, thereby causing, during the taking of showers or washings, an accumulation of water on the bathtub and shower stall floor that with the addition of hair, dirt and high density suds, makes it all the more difficult for the water to drain, becoming stagnant, which is most uncomfortable when taking a shower and also requires repeated cleaning afterwards. A similar situation is encountered when shampooing one's hair on the lavatory, where there will be normally a substantial accumulation of both high density suds and hair and the small openings of the screen cause the stagnation of water that with the addition of the aforementioned hair and suds makes it all the more difficult for the water to drain, requiring also repeated cleanings afterwards. Furthermore, a disadvantage of the existing conventional vertically extensible drain stoppers, hereinafter called pop-up stoppers, or the like, of the drain control systems of bathtubs, lavatories and the like, in reference to this problem, is that they are not designed to prevent clogging due to the accumulation of hair into said drainpipes. Therefore, there is no device which actually ends the clogging problem of drainpipes in a satisfactory way, and this proves the need for new means of solving this problem.

The present invention provides the means to overcome the foregoing problem and to avoid the aforementioned disadvantages of the prior art, offering novel means for preventing hair from clogging the drainpipes of bathtubs, lavatories and the like, consisting of spikes, bristles, open web of crinkled filaments, or rough indented openings of the net-like structure, to exert an entangling and gripping action upon the fallen hair, hairpins or any other object during the taking of showers or washings or the like, thereby allowing the provision of large enough openings of the net-like structure, and/or of the open web, which constitutes the body of the article, in order to insure the free flow of running water without hair into the drainpipe opening.

SUMMARY OF THE INVENTION

According to the present invention, there is provided a new article for preventing the clogging of drainpipes of bathtubs, lavatories and the like, particularly due to the accumulation of hair therein, during the taking of showers or washings or the like, preferably made of a suitable flexible and springy plastic material or of flexible and springly rubber, or of any other equally suitable material. The article could be produced by injection molding process or by extrusion process or by any other equally suitable process. The body of the article of the present invention is shaped to be adapted to surround the lifted conventional pop-up stoppers or the like of the drain control system of bathtubs, lavatories and the like, and it may take any of several preferred cross section forms, such as for example a hollow core elongated semicylindrical form which is integral with a flexible flat thin imperforate lower portion or base, providing several preferred undersurfaces, or a hollow core cylindrical form or a vertical strip-like form, or a cup-like form, or a stepped strip-like form, and said forms being constituted by a net-like structure with a plurality of openings which in the three last mentioned cross section forms is integral with imperforate zones and with an outwardly directed surrounding flat thin quite flexible imperforate base with a central hole defined therein with a size generally corresponding to that of the drainpipe opening, and the base providing several preferred undersurfaces. The outer surface of the net-like structure, and optionally of the imperforate zones, is provided, in several preferred embodiments, with flexible spikes or bristles or with an adherently bonded resilient open lofty integrated web of interengaged continuous crinkled large diameter filaments, which may be unmodified or modified, such as for example abrasive filaments or foamed filaments, to exert a gripping action over said fallen hair. In another example, only the outer face of the net-like structure may have rough indented openings to exert a gripping action upon the fallen hair. The body of the article of the present invention may also take other preferred cross section forms such as for example a solid core approximately cylindrical form or a solid core elongated approximately semicylindrical form, both said forms being configured by a resilient open lofty integrated web of interengaged continuous crinkled large diameter filaments bonded together at points of mutual contact, and the web, having said preferred configurations, forming an open dimensionally stable tough unitary structure. The unitary open web structure, configured as a solid core semicylindrical shape, has one of its surfaces flattened to be adherently bonded, on this flattened surface, to a flexible flat thin imperforate strip which constitutes a base, having a central hole defined therein of a size to provide, in a preferred embodiment of the article to be snapped on, adequate room for the conventional pop-up stopper or the like, or in another preferred embodiment of the article to surround the outer perimeter of the flange, and the base providing several preferred undersurfaces. The article of the present invention, in some of its preferred cross section forms, is preferably dimensioned to surround the aforementioned lifted conventional pop-up stoppers or the like, in such a way that the inner perimeter of the article is adjacent to the outer perimeter of the flange, and the outer perimeter of the article is preferably such as to extend a suitable distance over the surrounding area adjacent to the outer perimeter of the flange, to permit a secure installation of the base of the article over said area. And in others of its preferred cross section forms, the article is dimensioned to be snapped on around said lifted pop-up stoppers or the like, and to rest over the flange.

The article of the present invention, in its most preferred embodiments, prevents hair, hairpins or any other object carried away with the water flow during the taking of showers or washings or the like, from entering and clogging the drainpipes of bathtubs, lavatories and the like, through an entangling and gripping action carried out by the spikes or bristles or open lofty web of continuous crinkled filaments, or by rough indented openings of the net-like structure, in conjunction with a blocking action carried out by the shape of the article, in all its preferred cross section forms, that surround the entire lifted conventional pop-up stoppers or the like, of the drain control systems of bathtubs, lavatories and the like, and the entire surrounding area of the drainpipe opening, and both said actions being exerted upon the fallen hair, hairpins or any other object, carried away with the water flow when the article is installed around or snapped on around said lifted stoppers, while the net-like structure and/or the open web allow, with a plurality of large enough openings, the free flow of running water without hair into the drainpipe opening.

OBJECTS OF THE INVENTION

Accordingly, it is one of the major objects of the present invention to provide a new article which prevents hair, hairpins or any other object carried away with the water flow during the taking of showers or washings or the like, from entering and clogging the drainpipes of bathtubs, lavatories and the like, by means of an entangling and gripping action carried out by flexible spikes or bristles or by a resilient open lofty integrated web of continuous crinkled filaments, or by rough indented openings of the net-like structure, in conjunction with a blocking action carried out by the shape of the article, which is shaped to be adapted to surround entirely the lifted conventional pop-up stoppers or the like of the drain control systems of bathtubs, lavatories and the like, and both said actions being exerted upon the fallen hair, hairpins or any other object carried away with the water flow, thereby preventing said fallen hair, hairpins or any other object from entering and clogging said drainpipes.

It is another object of the present invention to provide an article of the above character which body, in some preferred examples, is constituted by a net-like structure with a plurality of openings which are large enough to allow the free flow of running water without hair into the drainpipes during the taking of showers or washings or the like.

It is another object of the present invention to provide an article of the above character having flexible spikes or bristles or an open lofty integrated web of crinkled filaments on the outer face of the net-like structure, or rough indented openings of said net-like structure, to exert an entangling and gripping action upon the fallen hair carried away with the water flow.

It is another object of the present invention to provide an article of the above character which body, in other preferred examples, is configured by a resilient open lofty integrated web of crinkled filaments, in order to exert an entangling action upon the fallen hair carried away with the water flow.

It is another object of the present invention to provide an article of the above character wherein the integrated web of crinkled filaments is open to allow, through large enough openings, the free flow of running water without hair into said drainpipes.

It is another object of the present invention to provide an article of the above character which body, is some preferred examples, has a flexible flat imperforate base with several preferred undersurfaces to provide a secure installation.

It is another object of the present invention to provide an article of the above character which is shaped to surround entirely the lifted conventional pop-up stopper or the like of the drain control systems of bathtubs, lavatories and the like in order to exert a blocking action upon the fallen hair carried away with the water flow during the taking of showers or washings or the like.

It is another object of the present invention to provide an article of the above character which body, in some of its preferred cross section forms, is preferably dimensioned to surround said lifted conventional pop-up stoppers or the like in such a way that its inner perimeter is adjacent to the outer perimeter of the flange, and in others of its preferred cross section forms said body is dimensioned to be snapped on around said lifted pop-up stoppers or the like.

It is another object of the present invention to provide an article of the above character which constitutes a means to actually eliminate the cause of the aforementioned problem in a simple, harmless and inexpensive way.

It is yet aother object of the present invention to provide an article of the above character which is easy to clean after each use and it is wear resistant, while its flexible spikes or bristles or integrated open web of continuous crinkled filaments will retain their shape and will not rust or shed.

It is a further object of the present invention to provide an article of the above character which is easy to manufacture and mass produce at low cost.

BRIEF DESCRIPTION OF THE DRAWINGS

While the specification concludes with claims particularly pointing out and distinctly claiming the subject matter of the present invention, it is believed that the invention can be more readily understood from the following description taken in connection with the accompanying drawings, in which:

DETAILED DESCRIPTION OF THE PREFERRED EMBODIMENTS

Figure 1:
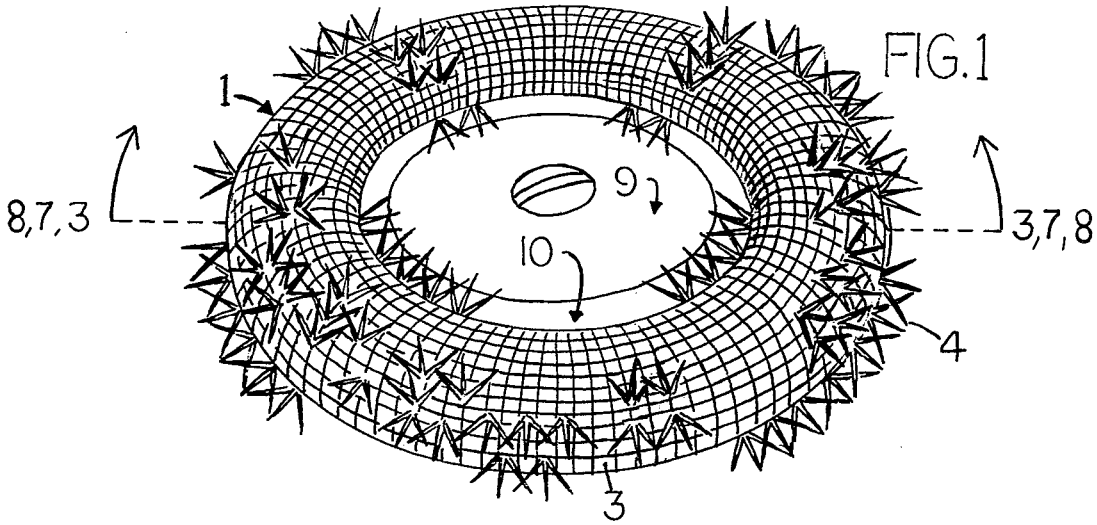
FIG. 1 is a perspective view of a preferred exemplary embodiment of the article as installed adjacent to the outer perimeter of the flange, around a conventional pop-up stopper of the drain control system of bathtubes and the like. The embodiment illustrated in this figure applies to all of the preferred embodiments of spikes, bristles or open web, or rough indented openings.

While this invention is susceptible of embodiment in many different forms, there is shown in the drawings and will herein be described in detail, preferred embodiments of the invention and modifications thereof, with the understanding that the present disclosure is to be considered as an exemplification of the principles of the invention, and is not intended to limit the invention to the embodiments illustrated. The scope of the invention will be pointed out in the appended claims. This discussion that follows is primarily directed to the use of the invention as applied to the various conventional pop-up stoppers or the like of the drain control systems of bathtubs, lavatories and the like, such as for example the trip lever pop-up stopper of bathtubs and the like, the pop-up stoppers of lavatories and the like, the push-button drain valve hereinafter called tip toe stopper, the turn-stop stopper, and any other similar stoppers, although it should be understood that the present invention could also be adapted to other drain control systems, and the detailed description of the invention and its use as applied to said stoppers will allow those skilled in the art to readily adapt the invention to other drain control systems.

Figure 3:
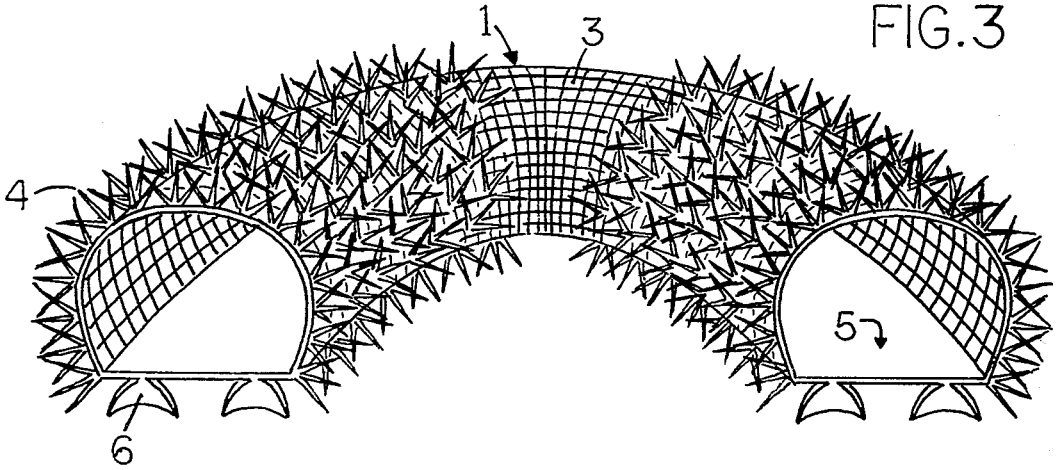
FIG. 3 is an enlarged perspective view of a transverse cross section of the preferred exemplary embodiment illustrated in FIG. 1 taken along section line 3—3 of FIG. 1.
Figure 4:
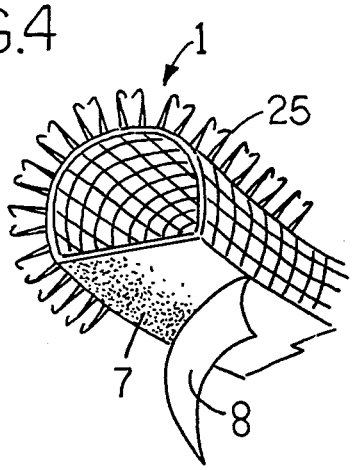
FIG. 4 is a perspective view of a fragmentary cross section of the preferred exemplary embodiment illustrated in FIG. 1 showing adhesive undersurface.
Figure 5:
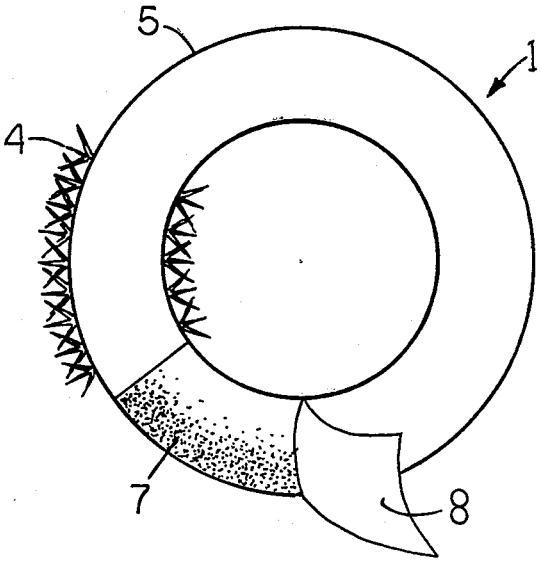
FIG. 5 is a plan view of the adhesive undersurface of the base of the preferred embodiment illustrated in FIG. 1. This plan view is also applicable to the preferred embodiments illustrated in FIGS. 7, 24 and 25. The undersurface illustrated in this figure optionally applies to all of the preferred exemplary embodiments of spikes, bristles, or open web, or rough indented openings.
Figure 6:
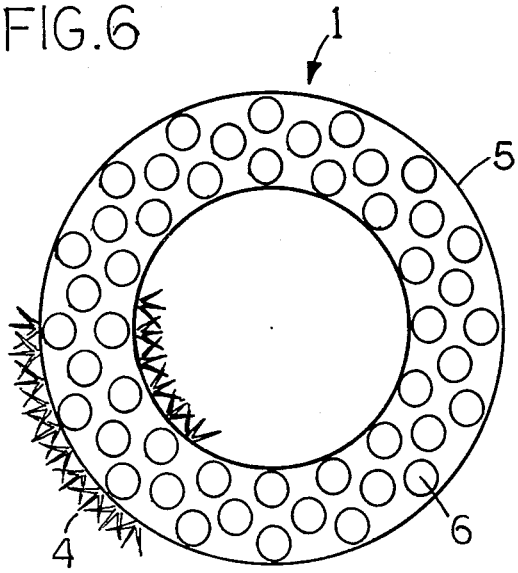
FIG. 6 is a plan view of the base of the preferred embodiment illustrated in FIG. 1 showing rows of suction cups. This plan view is also applicable to the preferred embodiment illustrated in FIG. 24. The undersurface illustrated in this figure optionally applies to all of the preferred exemplary embodiments of spikes, bristles or open web, or rough indented openings.

The article of the present invention has a preferred circular shape which may take any of several preferred cross section forms. FIGS. 1, 7, 8, 11, 13, 14, 15, 23 and 24 show the most preferred circular forms of the article which is made, in all its preferred embodiments, preferably of a suitable flexible and springy plastic material or of flexible and springy rubber, or of any other equally suitable material, and it could be produced by injection molding process or by extrusion process, although the injection molding process is considered more appropriate to obtain some of the preferred circular shapes of the article. If injection molding process is employed, different molds could be used, as it will be obvious to those skilled in the art, as per the detailed description and drawings of the article to obtain said most preferred circular shapes, as well as the different spikes or bristles. If extrusion process is employed, different extruder dies could be used, as it will be obvious to those skilled in the art, to obtain the most preferred circular shapes of the article, as well as the different spikes or bristles, and they could be produced by extrusion process similar to that utilized to extrude thermoplastic articles with spikes or bristles and optionally formed flat and tubular profiles disclosed in the U.S. Pat. No. 3,329,998, issed to C. Stöhr on July 11, 1967, and in U.S. Pat. No. 3,387,069 issued to C. Stöhr on June 4, 1968, and U.S. Pat. No. 3,923,442 issued to Arno Stöhr on Dec. 2, 1975, and U.S. Pat. No. 3,867,953 issued to Arno Stöhr on Feb. 25, 1975, said patents being hereby incorporated herein by reference. Also both aforementioned processes could be used in association and integrating means could be employed in an additional stage to adherently bond together different features. Of course, any other equally suitable process could also be employed. All the dimensions of the article of the present invention should be adapted to the different types of stoppers as well as to the size of stoppers used in bathtubs and the ones used in lavatories. Therefore, in the description that follows there will be given dimensions which intend to be only exemplary of one of said sizes and which could be subject in practice to modifications and adjustments whenever convenient. All of the preferred embodiments of the article are suitable to be used in bathtubs, as well as in lavatories or the like, although some of the preferred embodiments of the article are particularly suitable for one or the other. Therefore, there is intended a big size of the preferred embodiments of the article to be used in bathtubs and the like, and a small size to be used in lavatories and the like. In addition, all the preferred circular shapes of the articles are flexible and springy but have the necessary stiffness to stay firmly in place when installed. Now, in reference to the drawings, all the different types of stoppers are designated with the same numeral 9. Referring now to FIG. 1 there is shown one of the most preferred exemplary embodiments of the article, a circular hollow core elongated semicylindrical shape 1, as installed adjacent to the outer perimeter of the flange 10 around a pop-up stopper 9 of bathtubs and the like. This embodiment is particularly suitable to be used around all the different pop-up stoppers or the like of bathtubs and the like, being less practical for lavatories. The circular shape 1 comprises an upper portion or circular hollow core elongated semicylinder, constituted by a net-like structure with a plurality of openings 3, integral with a circular flexible flat thin imperforate lower portion which constitutes a base 5 (FIGS. 3, 5, 6), providing one adhesive undersurface 7 with removable baking paper 8 (FIGS. 4 and 5) which is entirely coated with any conventional commercially available pressure sensitive adhesive compatible with the plastic material used, which adhering properties are suitable for porcelain, cast-iron, steel fiberglass and other plastic surfaces of bathtubs, lavatories and the like, or another optional undersurface provided preferably with three rows of suction cups 6 (FIGS. 3 and 6) having for example an approximate diameter of 5/16". FIG. 6 shows three rows of suction cups 6 in a preferred disposition, although if desired only two rows of suction cups 6 could be employed. The outer surface of the net-like structure 3 bears a plurality of external ribs 2 (see FIG. 2) ending in flexible spikes 4 partially shown in this figure, or 24, or 25 (FIGS. 16 and 27), or bristles 26, 27, 29 (FIGS. 18, 19 and 21) uniformly spaced at a minimal distance from each other, and internal ribs 2' supporting the whole body of the circular shape 1.

The entire outer face of the net-like structure with a plurality of openings 3 of the preferred circular shape 1 (as well as of the other preferred circular shapes 12, 14, 17, 18 and 20) is provided, in several preferred exemplary emdodiments, with the flexible spikes 4, 24, 25, or bristles 26, 27, 29, or with rough indented openings (not shown) which will be described later in more detail, or with an adherently bonded resilient open lofty integrated web 28 (FIG. 22) of interengaged extruded continuous crinkled large diameter filaments of thermoplastic material, welded together at points of mutual contact, to form the integrated open web according with an integration treatment using commercially available liquid hardenable adhesive bonding resin, which upon hardening, permanently adheres the filaments together as a unitary structure. This liquid may be applied by immersing the web in a bath thereof or by spraying the web therewith. Such liquids may be in the form of a solvent solution of the bonding resin, as a hot melt of the resin or in any other convenient form. Hardening of such liquids will of course depend upon their form. Hardening of solvent solutions will be by solvent evaporation and hardening the melt will be by cooling. The open web 28 has one of its major surfaces flattened 33 (see FIG. 22) to provide an excellent contact surface for lamination, when it is laminated to the entire outer surface of the net-like structure 3, the latter being the substratum for the lamination of the web 28. The integrated open web 28 is bonded to the outer face of the plastic net-like structure with a plurality of openings 3 that constitute the upper portion or hollow core elongated semicylinder, using conventional adhesives, and coating the flattened surface 30 (FIG. 22) of the web with the liquid hardenable adhesive by any convenient means, e.g. brush, spray or roll coating, and pressing the net-like substrate against the adhesive coated surface with light or moderate pressure. Once the adhesive cures, the web and substrate become permanently adherently bonded together. The web could also be bonded without using adhesives by having the molten thermoplastic filaments fall upon the outer surface of the net-like structure 3, that constitutes the circular shape 1, and upon cooling, form an adherently bond between the substrate surface and the web, although this latter treatment may be less practical due to the form of the article of the present invention. It should be understood that in spite of the fact that the open web is adherently bonded to the outer face of the net-like structure 3 of the circular shape 1, according with conventional lamination treatments, the result is not defined herein as a dimensionally stable laminate since this is not the case of a sheet-like laminate. Optionally, in another preferred embodiment of the open web 28, the web 28 comprises abrasive filaments, and yet in another preferred embodiment the web 28 comprises foamed filaments, so that the filaments could exert also a gripping action over the fallen hair which have been entangled within the web 28. To produce these other preferred embodiments of filaments, the completed web is modified, prior to integration or lamination, by the addition of particulate materials such as abrasive grains to produce abrasive filaments, or by the addition of gases or blowing agents to produce foamed filaments. Also the completed web may be modified by any other means equally suitable to obtain filaments with the desired gripping action. The open lofty integrated web 28 of interengaged extruded continuous crinkled large diameter filaments, is preferably subjected to extrusion process and modification treatments to produce abrasive and foamed filaments, as well as integration and lamination treatments, similar to those utilized to extrude filaments as well as to integrate and laminate the open web of filaments, or to produce abrasive and foamed filaments disclosed in the U.S. Pat. No. 3,837,988 issued to D. E. Hennen el al on Sept. 24, 1974, said patent being hereby incorporated herein by reference.

Whereas the teachings of the hereinbefore incorporated U.S. Pat. No. 3,837,988 are concerned with applications of the open web to a composite mat especially suited for use as a floor covering, the intended use of the open web in the present invention is as a mean to avoid clogging of drainpipes of bathtubs, lavatories and the like, through the entangling action exerted by said open web of crinkled filaments upon the fallen hair, hairpins or any other object carried away with the water flow during the taking of showers or washings or the like, whether the open web is adherently bonded to the outer surface of the net-like structure of the preferred circular shapes 1, 12, 14, 17, 18 or 20 (FIGS. 1, 7, 8, 11, 13, 14 or 15), or whether the integrated open web 28 is configured to define the preferred circular shapes 31 or 32 (FIGS. 23 and 24), while the openness of the web serves the purpose of allowing the free flow of running water without hair into the drainpipe opening.

In FIG. 1, as well as in most other figures, the net-like structure is simplified for clarity purposes, except in FIGS. 2 and 16 to 19 and 21, where the net-like structure is illustrated in large scale. The circular hollow core elongated semicylindrical shape 1 preferably surrounds the lifted pop-up stopper 9 or the like, in such a way that the inner circumference of the circular base 5 of said circular shape 1 is adjacent to the outer circumference of the flange 10, and the outer circumference of the base 5 is such as to extend a suitable distance over the surrounding area adjacent to the outer circumference of the flange 10, to permit a secure installation of the base 5 of the article over said area, and the height of the circular shape 1, including the height of spikes 4, 24, 25, or bristles 26, 27, 29, or web 28, should preferably exceed the space defined between the flange 10 and the top of the lifted standard pop-up stoppers or the like, in order to offer a barrier against the fallen hair, hairpins or any other object carried away with the water flow. There is given an example of dimensions for the circular shape 1 to be used in bathtubs, which inner circumference is adjacent to the other circumference of the flange 10; diameter of the outer circumference of the base 5 preferably approximately $4\frac{5}{8}''$, diameter of the inner circumference of the base 5 preferably approximately $3\frac{1}{8}''$, width of the base 5 preferably approximately $\frac{3}{4}''$, height of semicylinder (excluding spikes, bristles or web) preferably approximately $\frac{7}{8}''$, height of spikes preferably approximately $\frac{1}{4}''$, total height of semicylinder (including spikes, bristles or open web) preferably approximately $1\frac{1}{8}''$.

Figure 7:
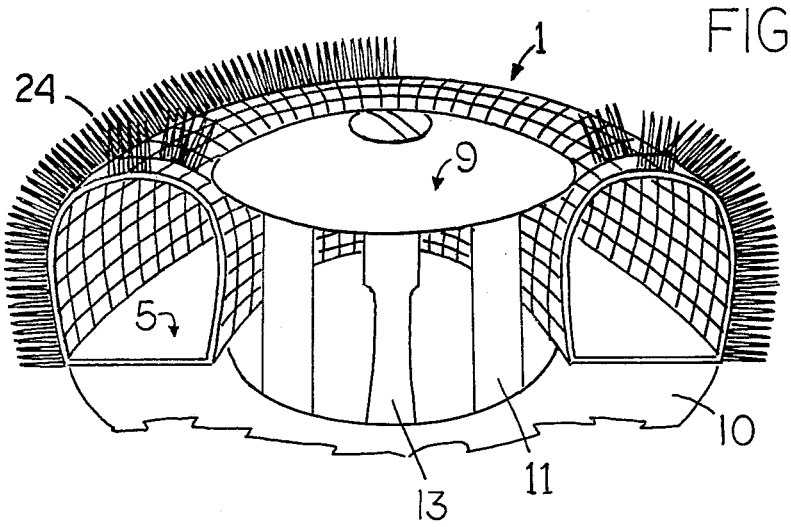
FIG. 7 is a perspective view in large scale of a transverse cross section of a reduced version of the preferred exemplary embodiment of FIG. 1 taken along section line 7—7 of FIG. 1, installed around a conventional pop-up stopper.
Figure 9:
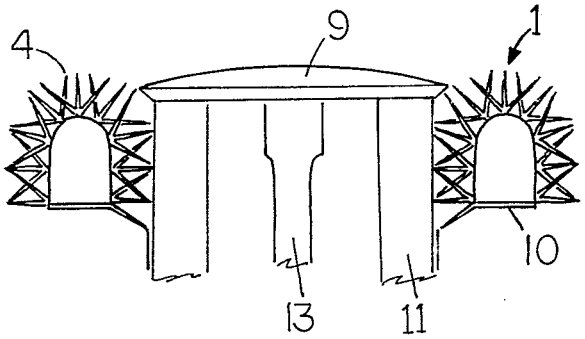
FIG. 9 is a schematic cross section view of the preferred exemplary embodiment illustrated in FIG. 7 as installed around a conventional lifted pop-up stopper of bathtubs, resting over the flange. This figure is scaled to about the actual size used on bathtubs.

Turning now to FIGS. 7 and 9, there is shown a reduced version of the preferred circular hollow core elongated semicylindrical shape 1, as installed around the trip lever pop-up stopper 9 with rods 11 and 13, resting over the flange 10. FIG. 7 shows a sample of spikes 24 and FIG. 9 shows a sample of spikes 4. The reduced version of the circular shape 1 has smaller dimensions in order to be snapped on around the lifted trip lever pop-up stopper, the tip toe stopper or the like of bathtubs and the like, or the pop-up stoppers of lavatories and the like. The height of the circular shape 1, in this reduced version including the height of spikes 4, 24, 25, or bristles 26, 27, 29, or open web 28, is preferably such as to adapt to the space defined between the flange and the top of said lifted stoppers, in order to be snapped on around said lifted stoppers and to cover the entire entrance to the drainpipe opening with its body including the height of spikes 4, 24, 25, or bristles 26, 27, 29 or open web 28 (see FIG. 9). And the inner circumference of the circular shape 1, in this reduced version, including the spikes 4, 24, 25, or bristles 26, 27, 29 or web 28, is preferably such as to surround closely the rods or fins or central vertical cylinder or the like, of said stoppers when said circular shape 1 is snapped on around said lifted stoppers (see FIG. 9) in order to stay firmly in place closely in contact with said lifted stoppers when the flexible and springy spikes 4, 24, 25, or bristles 26, 27, 29, or the adherently bonded resilient open lofty integrated web 28, illustrated in FIG. 22, of continuous crinkled unmodified or modified abrasive or foamed large diameter filaments, return to their original shape after bending when the circular shape 1 is snapped on. And the inner and outer circumferences of the flexible circular flat imperforate base 5 are preferably such as to adapt to the inner and outer circumferences of the flange 10, to permit a secure installation of the base 5 over the flange 10 (see FIG. 9). In this embodiment the base 5 provides also the aforementioned adhesive undersurface 7 or an optional plain self sealing undersurface (not shown). Since in this reduced version of the circular shape 1, the base 5 rests preferably entirely over the flange 10, there is no undersurface with suction cups 6. There is given an example of dimensions for the circular shape 1, adapted to be snapped on around one of several existing trip lever pop-up stoppers with rods, of bathtubs and the like: diameter of the outer circumference of the base 5 preferably approximately 3-3/16", diameter of the inner circumference of the base 5 preferably approximately 2⅜", width of the base 5 preferably approximately ⅜", height of semicylinder (excluding spikes, bristles or open web) preferably approximately 9/16", height of spikes 4, 24, 25, or bristles 26, 27, 29 or open web 28 preferably approximately ¼", total height of semicylinder (including spikes, bristles or open web) preferably approximately 13/16".

Figure 8:
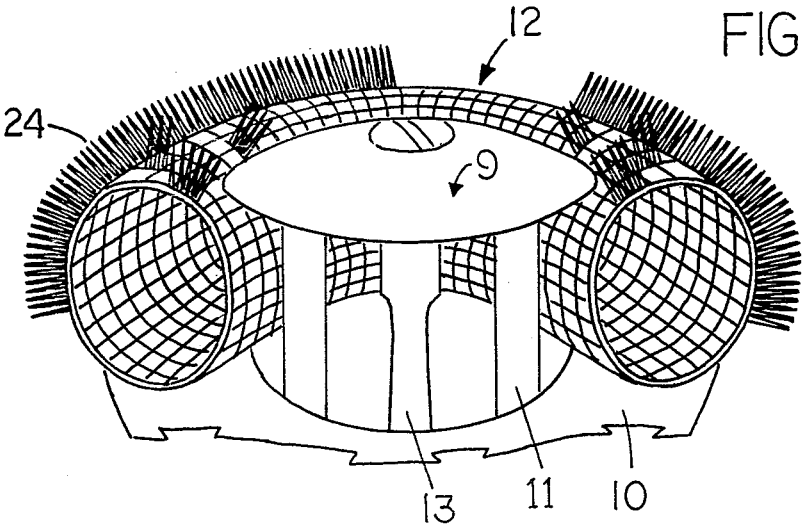
FIG.8 is a perspective view in large scale of another preferred exemplary embodiment of the article taken along section line 8—8 of FIG. 1, installed around a conventional pop-up stopper. Although the preferred embodiment illustrated in FIG. 1 is not the embodiment illustrated in this figure the perspective view of the cross section of both embodiments is quite similar for this purpose. The embodiment illustrated in this figure applies to all of the preferred embodiments of spikes, bristles or open web, or rough indented openings.
Figure 10:
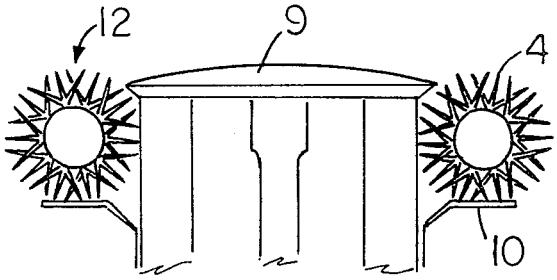
FIG. 10 is a schematic cross section view of the preferred exemplary embodiment illustrated in FIG. 8 as installed around a conventional lifted pop-up stopper, resting over the flange. This figure is scaled to about the actual size used on bathtubs.

Referring now to FIGS. 8 and 10 there is shown another most preferred exemplary embodiment of the article, a circular hollow core cylindrical shape 12 as installed around the trip lever pop-up stopper 9 with rods 11 and 13, of bathtubs and the like. This embodiment is also dimensioned to be snapped on, and is particularly suitable to be used with the trip lever pop-up stopper or the tip toe stopper, or the like, of bathtubs, and the like, or with the pop-up stoppers of lavatories and the like. The circular shape 12 is constituted by a net-like structure 3, the outer surface of which bears external ribs 2 ending in flexible spikes 4 (shown in FIG. 10), 24 (shown in FIG. 8), or 25, or bristles 26, 27, 29, uniformly spaced at a minimal distance from each other, and internal ribs 2' supporting the whole body of the circular hollow core cylindrical shape 12. The outer face of the net-like structure 3 is provided, in several embodiments, with the flexible spikes 4, 24, 25, or bristles 26, 27, 29, or with rough indented openings (not shown) or with the adherently bonded resilient open lofty integrated web 28 of continuous crinkled unmodified or modified abrasive or foamed large diameter filaments. The description of the open web 28 and the reference to its related manufacturing process, such as have been given for the preferred circular hollow core elongated semicylindrical shape 1, are equally applicable to this circular shape 12, as well as to the preferred circular shapes 14, 17, 18 and 20 (FIGS. 11, 13, 14 and 15) which will be described later on. The diameter of the cylindrical body of the circular hollow core cylindrical shape 12 including the height of spikes 4, 24, 25, or bristles 26, 27, 29, or web 28, is preferably such as to adapt to the space defined between the flange 10 and the top of said lifted stoppers, in order to be snapped on around said lifted stoppers and to cover the entire entrance to the drainpipe opening with its body including the height of spikes 4, 24, 25, or bristles 26, 27, 29, or open web 28 (see FIG. 10). And the inner circumference of the circular hollow core cylindrical shape 12, including said spikes 4, 24, 25, or bristles 26, 27, 29 or web 28 is preferably such as to surround closely the rods or fins or central vertical cylinder or the like, of said stoppers when said circular shape 12 is snapped on around said lifted stoppers (see FIG. 10), in order to stay in place closely in contact with said lifted stoppers, when the flexible and springy spikes 4, 24, 25, or bristles 26, 27, 29, or web 28 return to their original shape, after bending when said circular shape 12 is snapped on. And the inner and outer circumferences of the circular shape 12, including the spikes 4, 24, 25, or bristles 26, 27, 29, or web 28 are preferably such as to adapt to the inner and outer circumferences of the flange 10, so that the circular shape 12 preferably rests entirely over the flange 10 (see FIG. 10). There is given an example of dimensions for the circular shape 12 adapted to be snapped on around one of several existing trip lever pop-up stoppers with rods, of bathtubs and the like: diameter of the outer circumference (excluding spikes, bristles or open web) preferably approximately 3-1/16", diameter of the inner circumference (excluding spikes, bristles or open web) preferably approximately 2-5/16", diameter of cylinder (excluding spikes, bristles or open web) preferably approximately ⅜", height of spikes 4, 24, 25, bristles 26, 27, 29, or open web 28 preferably approximately ¼". Total diameter of cylinder (including spikes, bristles or open web) preferably approximately ⅞".

Figure 11:
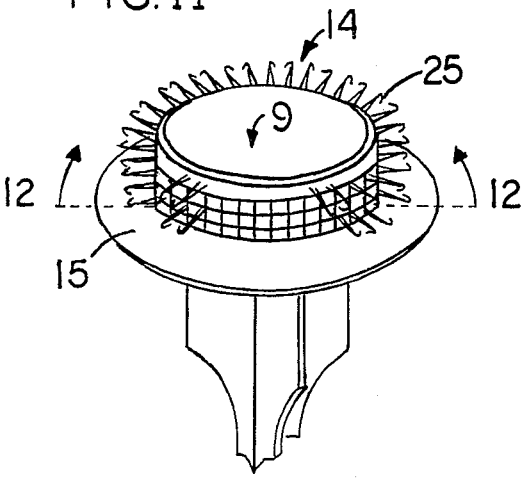
FIG. 11 is a perspective view of another preferred exemplary embodiment of the article as installed around a conventional lifted pop-up stopper, covering the flange with a flat base. The embodiment illustrated in this figure applies to all the preferred embodiments of spikes, bristles or open web or rough indented openings. This figure is scaled to about the actual size used in lavatories.
Figure 12:
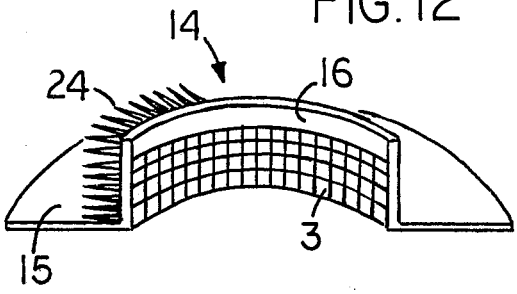
FIG. 12 is a perspective view of a transverse cross section of the preferred exemplary embodiment illustrated in FIG. 11 taken along section line 12—12 of FIG. 11.

FIGS. 11 and 12 illustrate another most preferred exemplary embodiment of the article, a circular vertical strip-like shape 14, suitable to be used with pop-up stoppers, or with the turnstop stopper or the tip toe stopper, or the like, of bathtubs, lavatories and the like. Turning now to FIG. 11 there is shown the circular shape 14 as installed around one of the existing pop-up stoppers 9 of lavatories and covering the flange 10, with a flat imperforate base 15. The circular vertical strip-like shape 14 comprises a circular upper portion 16 which is preferably imperforate (see FIG. 12) which surrounds the edge of the top of said stoppers, integral with a circular lower portion constituted by a net-like structure with a plurality of openings 3, which covers the space defined between the flange 10 (not shown in FIG. 11) and the top of said stoppers and surrounds the drainpipe opening. The lower portion is integral with an outwardly directed surrounding flat thin quite flexible circular imperforate base 15 with a circular central hole defined therein of a size generally corresponding to that of the drainpipe opening. In a preferred embodiment, the base 15 covers only the flange 10 and in another preferred embodiment it covers the flange and also extends a suitable distance over the surrounding area adjacent to the outer perimeter of the flange and the lower face of the base provides one adhesive undersurface or an optional plain self sealing undersurface (not shown). The outer face of the net-like structure with a plurality of openings 3 that constitutes the lower portion of the circular shape 14 is provided, in several embodiments, with the flexible spikes 4, 24, 25, or bristles 26, 27, 29, or with rough indented openings (not shown), or with the previously described adherently bonded resilient open lofty integrated web 28 of continuous crinkled unmodified or modified abrasive or foamed large diameter filaments. FIG. 11 shows a sample of spikes 25, and FIG. 12 a sample of spikes 24. And the height of the circular shape 14 is determined by the space defined between the flange 10 and the top of the lifted pop-up stopper 9 or the like, and its circumferential dimension is such as to adapt to the circumferential dimension of the top of said lifted stopper 9, so that the upper edge of the circular vertical strip-like shape 14 fits tightly along the perimeter of the top of the lifted pop-up stopper 9 when placed around said stopper 9 with its base resting over the flange 10 and the upper edge of the circular shape 14 is flush with the edge of the top of said stopper 9 (see FIG. 11).

Figure 13:
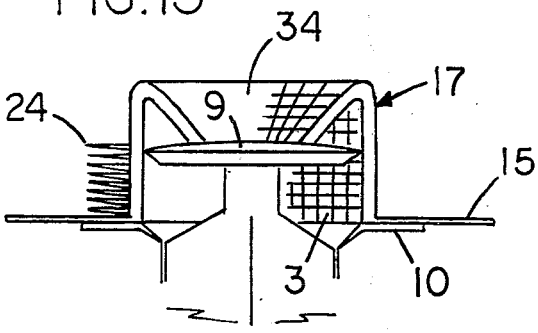
FIG. 13 is a schematic cross section view of another preferred embodiment of the article as installed around a conventional pop-up stopper of lavatories. The embodiment illustrated in this figure applies to all the preferred embodiments of spikes, bristles or open web or rough indented openings. This figure is scaled to about the actual size used in lavatories.

FIG. 13 shows another preferred embodiment of the article, a circular vertical strip-like shape 17 which is similar to the preferred circular shape 14, except for having an extended and bent upper portion. The upper portion is bent inward and downward towards the top of the tip toe stopper or pop-up stopper or the like of bathtubs, lavatories and the like, at an angle of preferably approximately 45° touching with the folded upper edge the top of said lifted stoppers. The extended bent segment 34 of the circular vertical strip-like shape 17 is constituted by a net-like structure with a plurality of openings 3, the outer face of which is also provided with the spikes 4, 24, 25, bristles 26, 27, 29 or open web 28, or rough indented openings (not shown), and the circular shape 17 has no imperforate zone 16.

Figure 14:
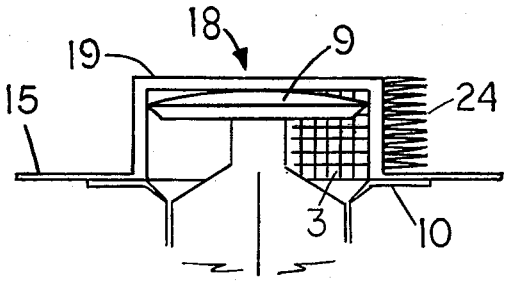
FIG. 14 is a schematic cross section view of another preferred exemplary embodiment of the article as installed over and around a conventional pop-up stopper of lavatories. The embodiment shown in this figure applies to all the preferred embodiments of spikes, bristles or open web, or rough indented openings. This figure is scaled to about the actual size used in lavatories.

FIG. 14 shows another preferred exemplary embodiment of the article, a circular cup-like shape 18 as installed over and around a conventional pop-up stopper 9 of lavatories, with the base 15 resting over the flange 10 and over the area surrounding the outer perimeter of the flange 10. The circular shape 18 is suitable to be used with the pop-up stoppers, the tip toe stopper, the turnstop stopper, or the like, of bathtubs, lavatories (and the like). The circular cup-like shape 18 covers the top of the stopper 9, as well as the space defined between the flange 10 and said top, and comprises a generally flat top portion 19 which is preferably imperforate, although if desired it could be perforate, and said top portion 19 goes over the top of the stopper 9 and it is integral with a circular strip-like vertical lower portion constituted by a net-like structure with a plurality of openings 3 which covers the space defined between the flange 10 and the top of the stopper 9 surrounding the drainpipe opening. The circular vertical lower portion constituted by a net-like structure 3 is integral with an outwardly directed surrounding flat thin quite flexible circular imperforate base 15 with a circular central hole defined therein of a size generally corresponding to that of the drainpipe opening. The base 15 covers, in a preferred embodiment, only the flange 10, and in another preferred embodiment it covers the flange and the surrounding area adjacent to the outer perimeter of the flange and privides one adhesive undersurface or an optional plain self sealing undersurface (not shown). The outer face of the net-like structure with a plurality of openings 3 of the vertical lower portion of the circular shape 18 and also if desired of the imperforate top portion 19, is provided with the flexible spikes 4, 24, 25, bristles 26, 27, 29, or open web 28 or rough indented openings (not shown). And the height and circumferential dimension of this embodiment are also adapted to the dimensions of the stopper 9, as in the case of the circular shape 14.

Figure 15:
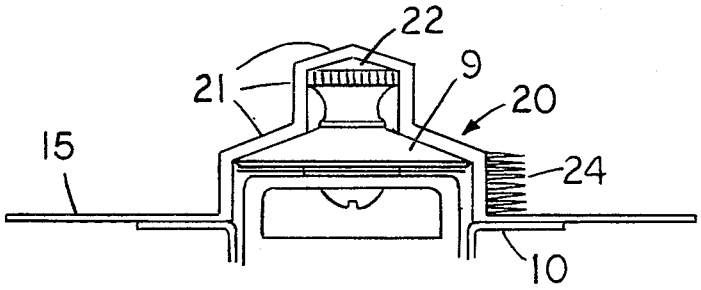
FIG. 15 is a schematic cross section view of another preferred exemplary embodiment of the article as installed around a conventional turnstop stopper. The embodiment shown in this figure applies to all the preferred embodiments of spikes, bristles or open web or rough indented openings. This figure is scaled to about the actual size used in bathtubs.

FIG. 15 illustrates another preferred exemplary embodiment of the article, a circular stepped strip-like shape 20 as installed around a conventional turnstop stopper or the like of bathtubs and the like, with the base 15 resting over the flange 10 and over the area surrounding the outer perimeter of the flange 10. The circular shape 20 is particularly suitable to be used with the turnstop stopper or the like, of bathtubs and the like. The circular shape 20 comprises a circular stepped upper portion 21 which is preferably imperforate, configured to define the contour of the top and of the knob 22 of the stopper 9 which is integral with a circular strip-like vertical lower portion constituted by net-like structure with a plurality of openings 3 that covers the space defined between the flange 10 and the top of said stopper and surrounds the drainpipe opening. The circular vertical lower portion constituted by a net-like structure 3 is integral with the previously described base 15 which provides an adhesive undersurface or a plain self sealing undersurface (not shown) that covers, in a preferred embodiment only, the flange 10, and in another preferred embodiment it covers the flange and the surrounding area adjacent to the outer perimeter of the flange. The outer face of the net-like structure with a plurality of openings 3 of the vertical lower portion of the circular shape 20 is provided with the flexible spikes 4, 24, 25 or bristles 26, 27, 29, open web 28, or rough indented openings (not shown). And the height of the circular shape 20 is determined by the space defined between the flange 10 and the top of the knob 22 of the lifted turnstop stopper 9, and its circumferential dimension is such as to adapt to the circumferential dimension of the lifted stopper 9, so that the circumference of the vertical upper segment of the imperforate upper portion 21 of the circular shape 20 fits tightly along the perimeter of the knob 22, and the circumference of the vertical lower portion fits tightly along the perimeter of the top of the lifted stopper 9, when the circular shape 20 is placed around the stopper 9 with the base 15 resting over the flange 10, and optionally over the surrounding area adjacent to the outer perimeter of the flange 10.

Figure 2:
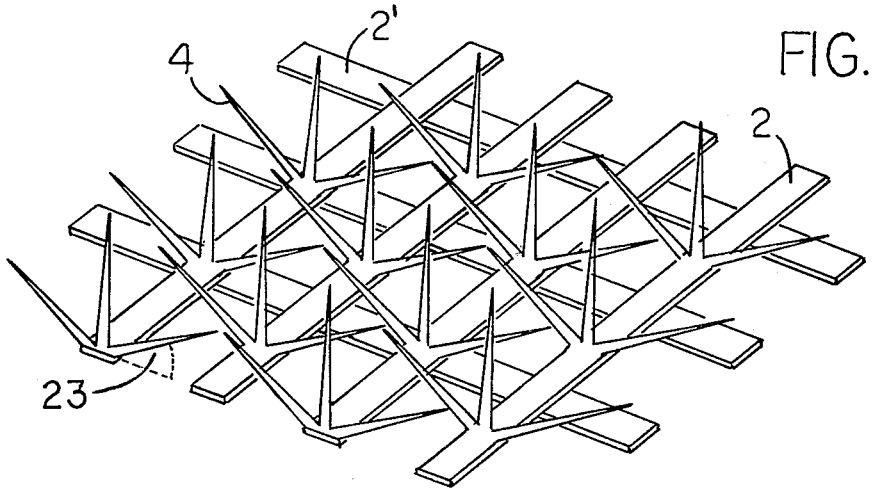
FIG. 2 is a perspective view in large scale of a preferred exemplary embodiment of spikes.

Referring now to the preferred embodiments of spikes 4, 24, 25, or bristles 26, 27, 29 which are provided over the outer face of the preferred circular shapes 1, 12, 14, 17, 18 and 20, uniformly spaced at a minimal distance from each other over the net-like structure 3 and optionally over the imperforate zones of the preferred circular shapes 14, 17, 18 and 20 there is shown in FIG. 2 the external ribs 2 of the net-like structure 3 ending in spikes 4 with straight tips which are disposed in groups of three spikes 4 radially arranged preferably on a same plane on said external ribs 2. Each group of three spikes opposes each other diagonally and alternately according to the following disposition: every two parallel external ribs 2, said groups of three radially disposed spikes 4 are spaced at a minimal distance from each other group, preferably at the intersection of the external and internal ribs 2 and 2' of the net-like structure 3, and every two intercalated parallel external ribs 2 the radially disposed groups of spikes 4 are spaced at a minimal distance from each other group, preferably at the middle of each of the segments of the external ribs 2 that are so determined by two of said intersections. The middle spikes 4 of each group of three spikes 4 is perpendicular to the external ribs 2, and the other two spikes 4 of each group of spikes 4 are at an angle 23 to the external rib 2 so that the outer spikes 4 of every two intercalated groups cross each other or that at least their tips are in touch, thus forming a net-like surface against the fallen hair. The groups of three spikes 4 are preferably arranged on the external ribs 2 in such a way as to present a frontal net-like surface against the fallen hair carried away with the water flow during the taking of showers or washings or the like. This embodiment in particular allows the provision of large enough openings of the net-like structure 3 due to the above mentioned arrangement, and if desired the rows of radially disposed rows of spikes 4 could be increased as well as the height of the spikes 4 proportionately to the enlargement of the opening.

Figure 16:
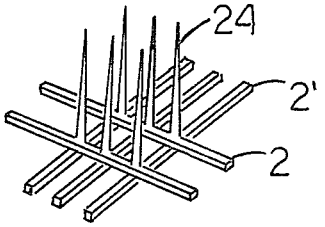
FIGS. 16 and 17 are perspective views in large scale of preferred exemplary embodiments of spikes.

FIG. 16 illustrates the external ribs 2 of the net-like structure 3 ending in spikes 24 with straight tips, and the internal ribs 2'.

Figure 17:
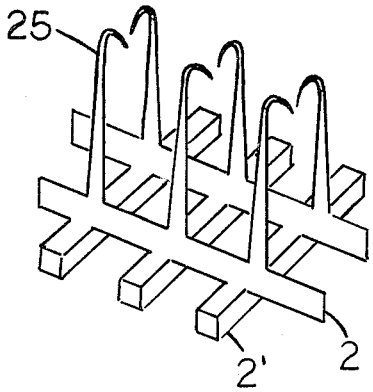

FIG. 17 illustrates the external ribs 2 of the net-like structure 3 ending in spikes 25 with Burdock-like hooked tips wherein pairs of adjacent spikes 25, (or bristles, not shown) are bent against each other. Internal ribs 2' support said external ribs 2.

Figure 18:
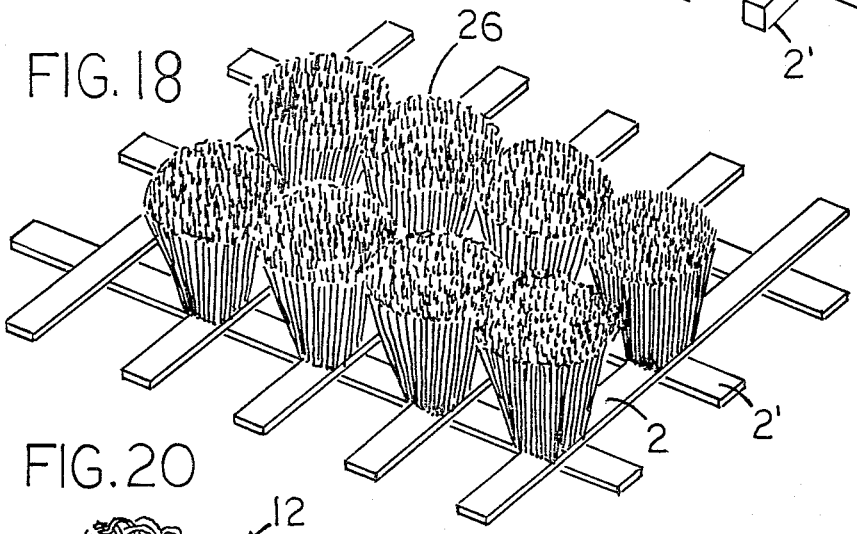
FIGS. 18, 19 and 21 are perspective views in large scale of preferred exemplary embodiments of bristles.

FIG. 18 illustrates the external ribs 2 of the net-like structure 3 ending in bristles 26 (or spikes, not shown) grouped as small inverted cone-shaped bunches, and the internal ribs 2'.

Figure 19:
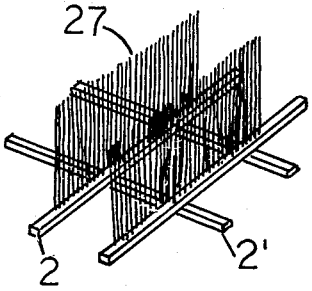

FIG. 19 illustrates rows of contiguous bristles 27 (or spikes, not shown) over the external ribs 2, and the internal ribs 2'.

Figure 20:
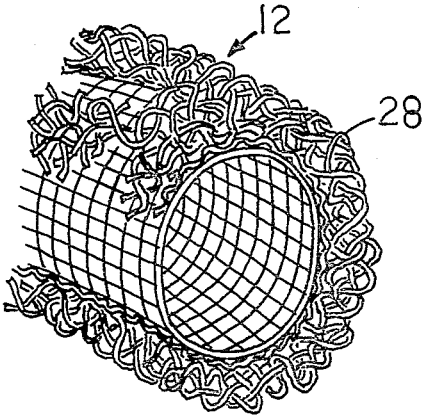
FIG. 20 is a perspective view in large scale of a fragmentary cross section of the preferred exemplary embodiment illustrated in FIG. 8 showing the preferred exemplary embodiment of the open web of crinkled filaments.

FIG. 20 shows the preferred circular hollow core cylindrical shape 12 of FIG. 8 illustrating the preferred exemplary embodiment of the resilient open lofty integrated web 28 of interengaged continuous irregularly coiled unmodified or modified abrasive or foamed large diameter filaments. The open web 28 is adherently bonded, on its flattened surface 30 (see FIG. 22) to the outer surface of the net-like structure as has been previously described. For the preferred embodiment of the open web 28 illustrated in this figure, as well as in FIGS. 22, 23 and 24, a suitable diameter of the filaments may be between about 5 to 65 mils and preferably 10 to 35 mils. In this figure, and also in FIGS. 22, 23 and 24, the filaments are slightly exaggerated for clarity purposes.

Figure 21:
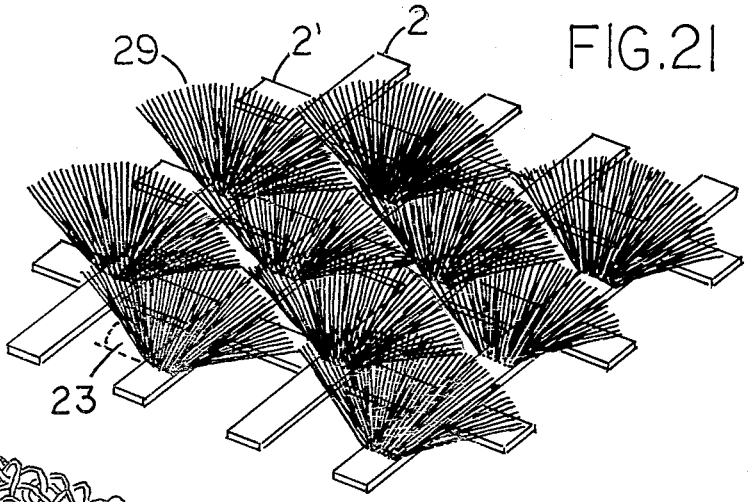

FIG. 21 illustrates external ribs 2 ending in bristles 29 (or spikes, not shown) grouped in a fan-like shape. Each fan-shaped group opposes each other diagonally and alternately according to the following disposition: every two parallel external ribs 2, groups of bristles 29 (or spikes) in a fan-like shape are spaced at a minimal distance from each other group, preferably at the intersections of the external and internal ribs 2 and 2' of the net-like structure 3, and every two intercalated parallel external ribs 2, groups of bristles 29 (or spikes) in a fan-like shape are spaced preferably at the middle of each one of the segments of the external ribs 2 that are so determined by two of the said intersections, being the outer bristles of the fan-like shaped groups of bristles 29 (or spikes) at an angle 23 to the external ribs 2, so that the outer bristles 29 (or spikes) of every two intercalated fan-like shaped groups cross each other or at least their tips are in touch thus forming a net-like surface against the fallen hair. The fan-like shaped groups of bristles 29 (or spikes) are preferably arranged on the external ribs 2 in such a way as to present a frontal net-like surface against the fallen hair carried away with the water flow during the taking of showers or washings or the like. This embodiment in particular allows the provision of large enough openings of the net-like structure 3 due to the above mentioned arrangements, and if desired the rows of fan-like shaped groups of bristles 29 (or spikes) could be increased as well as the height of the spikes 29 (or bristles) proportionately to the enlargement of the openings.

Figure 22:
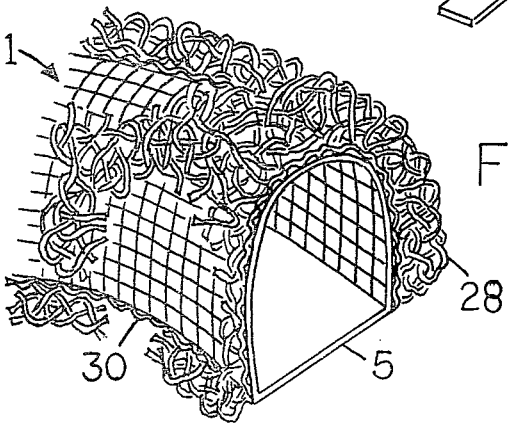
FIG. 22 is a perspective view of a fragmentary cross section of the preferred exemplary embodiment illustrated in FIGS. 1 and 7 showing the preferred exemplary embodiment of the open web of crinkled filaments.

FIG. 22 shows the preferred circular hollow core semicylindrical shape 1 of FIGS. 1 and 7 illustrating the preferred exemplary embodiment of the resilient open lofty integrated web 28 of interengaged continuous irregularly coiled unmodified or modified abrasive or foamed large diameter filaments. The open web 28 is adherently bonded on its flattened surface 30, as has been previously described, to the outer surface of the net-like structure that constitutes the upper portion or hollow core semicylinder of the circular shape 1.

The embodiment of the open web 28 as illustrated in FIGS. 20 and 22 is also applicable to the preferred embodiments of the article illustrated in FIGS. 11, 13, 14 and 15.

To determine the height of the spikes 4, 24, 25 or bristles 26, 27, 29 or open web 28, in the reduced version of the preferred circular shape 1 and in the circular shape 12, it should be taken into account the space defined between the flange 10 and the top of said lifted stoppers as well as the dimensions that should be given to the body of the article. In reference to the height of the spikes 4, 24, 25, bristles 26, 27, 29 or open web 28, in the reduced version of the preferred circular shape 1 and in the preferred circular shape 12, it is desirable that they be in touch or very close to the top portion of the stoppers, to avoid a gap between the circular shapes 1 and 12 and the top portion of said stoppers, after the article has been snapped on.

Furthermore, the spikes or bristles should be spaced preferably at a minimal distance so as to increase the effectiveness of the entanging action while the openings of the net-like structure and the openings of the open web should have suitable dimensions to allow the free flow of running water without hair into the drainpipe opening.

There is given an example of a height of spikes 4, 24, 25 or bristles 26, 27, 29 or open web 28 which might be suitable for the preferred circular shapes 1, in the embodiment which is adjacent to the outer circumference of the flange 10, as well as in the embodiment which is to be snapped on, and also for the preferred circular shapes 12, 14, 17, 18 and 20, and said height may be approximately ¼".

Figure 23:
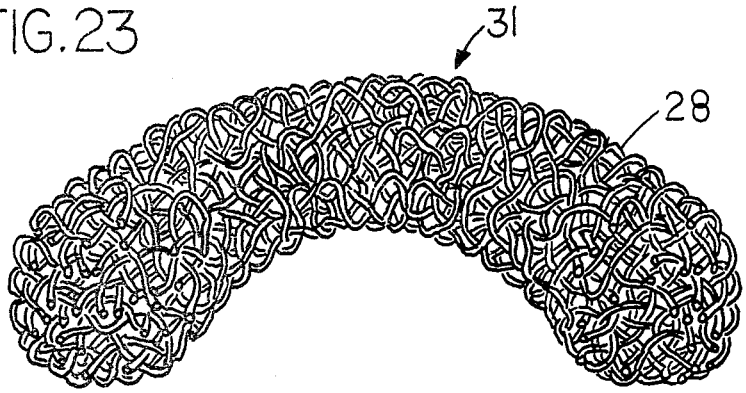
FIG. 23 is a perspective view in large scale of a transverse cross section similar to FIG. 8 illustrating another preferred exemplary embodiment of the article.

Referring now to FIG. 23, there is shown another most preferred exemplary embodiment of the article, a circular solid core approximately cylindrical shape 31. This embodiment is dimensioned to be snapped on and is suitable to be used with the pop-up stopper, the tip toe stopper, the turnstop stopper or the like, of bathtubs, lavatories and the like. The circular shape 31 is configured by the previously described resilient open lofty integrated web 28 of interengaged extruded continuous crinkled large diameter filaments of thermoplastic material welded together at points of mutual contact, and an integrating means, previously mentioned for the circular shape 1, adherently bonded to at least a portion of said filaments to provide structural integrity to the web, in order to constitute a tough unitary structure configured to define the circular solid core approximately cylindrical shape 31, the open web 28 being resilient but having the necessary stiffness to keep said cylindrical configuration.

Optionally, in another preferred embodiment, the open web 28, as has been previously mentioned for the preferred circular shape 1, comprises abrasive filaments and yet in another preferred embodiment the web 28 comprises foamed filaments, so that the filaments could have also a gripping action over the fallen hair. The diameter of the cylindrical body of the circular solid core approximately cylindrical shape 31, configured by the open web 28, is preferably such as to adapt to the space defined between the flange 10 and the top of said lifted stoppers, in order to be snapped on around said lifted stoppers and to cover with its body the entire entrance to the drainpipe openings. And the inner circumference of the circular solid core approximately cylindrical shape 31 is preferably such as to surround closely the rods or fins or central vertical cylinder or the like of said stoppers, when the circular shape 31 is snapped on around said lifted stoppers in order to stay firmly in place closely in contact with said lifted stoppers, when the resilient open web 28 of continuous crinkled filaments returns to its original shape after bending when said article is snapped on, and the inner and outer circumferences of the circular solid core approximately cylindrical shape 31, are preferably such as to extend a suitable distance beyond the inner and outer circumferences of the flange 10, and the circular shape 31 resting preferably entirely over the flange 10. There is given an example of dimensions for the circular shape 31 to be snapped on around one of several existing trip lever pop-up stoppers with rods, of bathtubs and the like; diameter of the outer circumference preferably approximately 3½", diameter of the inner circumference preferably approximately 1 15/16", diameter of the cylinder preferably approximately ¾".

Figure 24:
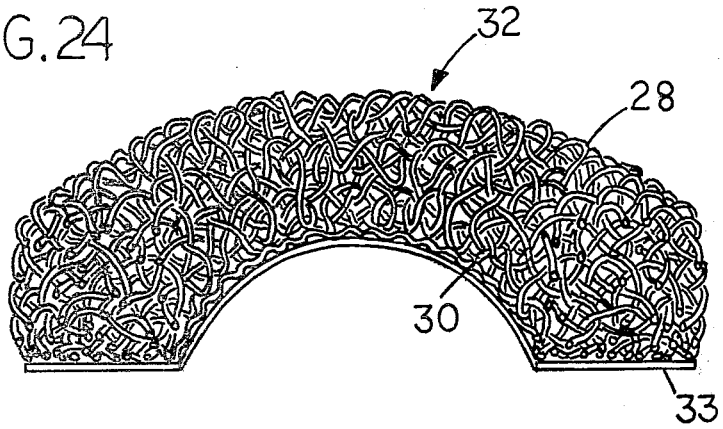
FIG. 24 is a perspective view in large scale of a transverse cross section similar to FIG. 7 illustrating another preferred exemplary embodiment of the article.

FIG. 24 illustrates another most preferred exemplary embodiment of the article, a circular solid core elongated approximately semicylindrical shape 32. This embodiment is dimensioned to be installed adjacent to the outer circumference of the flange 10 and is suitable to be used around all the different aforementioned stoppers of bathtubs and the like, being less practical for lavatories. The circular shape 32 comprises an upper portion with a circular semicylindrical shape being configured by the previously described resilient open lofty integrated web 28 of interengaged extruded continuous crinkled large diameter filaments of thermoplastic material welded together at points of mutual contact, and an integrating means previously mentioned for the circular shape 1, adherently bonded to at least a portion of said filaments to provide structural integrity to the web 28 in order to constitute a tough unitary structure, the open web 28 being resilient but having the necessary stiffness to be configured to define said circular solid core approximately semicylindrical shape 32. The web 28 has one major surface flattened 30, containing a higher concentration of filaments adjacent the flattened surface 30 than within the inner portion of the said web to provide an excellent contact surface when the web 28, configured as a circular solid core approximately semicylindrical shape, is adherently bonded according with the treatment previously described for the circular shape 1, on its flattened surface 30, to the lower portion of the article constituted by a flexible flat thin circular imperforate strip of plastic material which constitutes a base 33 having a circular central hole defined therein of an adequate size in order to surround the outer circumference of the flange, and the base providing one adhesive undersurface 7 (see FIG. 5) or an optional undersurface with rows of suction cups 6 (see FIG. 6). The description of both undersurfaces such as has been given for the preferred circular shape 1 are equally applicable to the circular shape 32. Optionally, in another preferred embodiment, the open web 28 comprises said abrasive filaments, or said foamed filaments, so that the filaments could have also a gripping action over the fallen hair which have been entangled within the web 28. The physical treatment of the web for producing the preferred abrasive and formed filaments has been previously mentioned for the preferred circular shape 1. The circular solid core elongated approximately semicylindrical shape 32 preferably surrounds the lifted pop-up stopper 9 or the like, in such a way that the inner circumference of the flexible flat thin imperforate circular base 33, is adjacent to the outer circumference of the flange 10, and the outer circumference of the base 33 is preferably such as to extend a suitable distance over the surrounding area adjacent to the outer circumference of the flange 10, to permit a secure installation of the base 33 of the article over said area, and the height of the circular shape 32 should preferably exceed the space defined between the flange 10 and the top of the lifted standard pop-up stoppers or the like, in order to offer a barrier against the fallen hair, hairpins or any other object carried away with the water flow. There is given an example of dimensions for the circular shape 32 to be used in bathtubs, which inner circumference is adjacent to the outer circumference of the flange 10: diameter of the outer circumference of the base 33 preferably approximately 5⅛", diameter of the inner circumference of the base 33 preferably approximately 3⅛", width of base 33 preferably approximately 1", height of semicylinder preferably approximately 1⅛".

Figure 25:
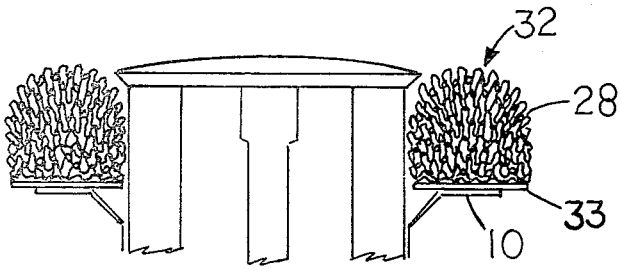
FIG. 25 is a schematic cross section view of a reduced version of the preferred exemplary embodiment illustrated in FIG. 24 as installed around a conventional pop-up stopper of bathtubs, resting over the flange. This figure is scaled to about the actual size used in bathtubs.

There is provided for the preferred circular shape 32 a reduced version with smaller dimensions (see FIG. 25) in order to be snapped on around the lifted standard trip lever pop-up stoppers, or the tip toe stopper or the like of bathtubs and the like, and the pop-up stopper of lavatories and the like. In this reduced version the height of the circular solid core elongated approximately semicylindrical shape 32, configured by the open web 28, is preferably such as to adapt to the space defined between the flange and the top of said lifted stoppers, in order to be snapped on around said lifted stoppers and to cover with its body the entire entrance to the drainpipe openings. And the inner circumference of the circular shape 32 is preferably such as to surround closely the rods or fins or central vertical cylinder or the like of said stoppers, in order to stay firmly in place, closely in contact with said lifted stoppers when the resilient open web 28 of continuous crinkled unmodified or modified abrasive or foamed, large diameter filaments, returns to its original shape after bending when the circular shape 32 is snapped on, and the inner and outer circumferences of the flexible flat thin circular imperforate base 33 with a circular central hole are preferably such as to extend a suitable distance beyond the inner and outer circumferences of the flange 10. In this reduced version of the circular shape 32, the base 33 provides one adhesive undersurface 7 (see FIG. 5) or an optional plain self sealing undersurface (not shown). Since in this reduced version of the circular shape 32 the base 33 rests preferably over the flange 10, there is no undersurface with suction cups 6. There is given an example of dimensions for the circular shape 32 adapted to be snapped on around one of several existing trip lever pop-up stoppers with rods, of bathtubs and the like: diameter of the outer circumference of the base 33 preferably approximately 3 7/16", diameter of the inner circumference of the base 35 preferably approximately 1 15/16", width of the base 33 preferably approximately ¾", height of semicylinder preferably approximately ¾".

The resilient open lofty integrated web 28 of interengaged extruded continuous crinkled unmodified or modified abrasive or foamed large diameter filaments configured to define the preferred circular shapes 31 and 32, is preferably subjected to extrusion process and modification treatment, to produce abrasive and foamed filaments, as well as integration and lamination treatments similar to those utilize to extrude filaments as well as to integrate and laminate the open web of filaments, or to produce abrasive and foamed filaments disclosed in the hereinbefore incorporated U.S. Pat. No. 3,837,988.

In another preferred exemplary embodiment (not shown), the net-like structure with a plurality of openings that constitutes the body of the article in the circular shapes 1, 12, 14, 17, 18 or 20, may have rough indented openings, and the rough indented edges of said openings protrude a suitable length and extend preferably perpendicularly to the net-like structure 3, thus the outer face of the net-like structure 3 is provided with a surface similar to the surface of a grater, exerting a gripping action upon the fallen hair. In this embodiment of rough indented openings, the dimensions of the body of the article of the preferred circular shape 1 in its reduced version, and of the preferred circular shape 12, are the same as the dimensions given as examples for the reduced version of the circular shape 32 and for the circular shape 31. Any other feature which could exert an entangling or gripping action upon the fallen hair, in addition to the ones described herein, may also be employed. Furthermore, the preferred circular shape 14, 17, 18 or 20, if desired, could also be made of a more permanent material such as brass, stainless steel, bronze, copper or the like, by casting process, or by any other equally suitable process, in which case they are provided with flexible spikes or bristles of brass, stainless steel, bronze, copper or the like, or with a bond flexible open lofty web of continuous irregularly coiled filaments of brass, stainless steel, bronze, copper or the like, being the diameter of the filaments between about 5 to 65 mils, and preferably 10 to 35 mils. The metal web could be produced by extrusion and "knitting" processes well known to those skilled in the art. Optionally, in this embodiment, using a more permanent material, the outer face of the net-like structure with a plurality of openings 3 that constitutes the body of the circular shapes 14, 17, 18 or 20, may have the aforementioned rough indented openings (not shown), or the circular shapes 14, 17, 18 or 20 may be provided with any other feature which could exert an entangling or gripping action. The spikes or bristles uniformly spaced at a minimal distance from each other, as well as the bonded open web, are placed preferably only over the net-like structure that covers the space defined between the flange and the top of the stopper. In this embodiment, the circular shapes 14, 17, 18 and 20 comprise the previously described base 15 and the perforate and imperforate zones, although if desired, they could comprise only a perforate body without imperforate zones. In this embodiment the circular shapes 14, 17, 18 and 20 are also dimensioned as previously described.

From the aforegoing detailed description of the article, it will be apparent that numerous modifications can be made without affecting the concept of the invention.

No specific data were given herein in regard to the kind of adhesives, bonding resins and other substances that may be used in practicing the invention, and also in regard to specific grades of materials which are best suited for the article of the present invention. It should be noted, however, that these characteristics, materials and other details are well known to those skilled in the art, and no protection is sought for these expedients beyond the features explained hereinbefore and set forth in the claims.

The present invention, in its most preferred circular shapes, in order to prevent fallen hair, hairpins or any other object carried away with the water flow during the taking of showers or washings or the like, from entering and clogging the drainpipes of bathtubs, lavatories and the like, is to be installed around, or snapped on around the lifted conventional pop-up stopper or the like, of the drain control systems of bathtubs, lavatories and the like. The objective of preventing hair, hairpins or any other object from entering and clogging the drainpipes, is then carried out through the entangling action exerted upon the fallen hair, hairpins or any other object carried away with the water flow by the flexible spikes 4, 24, 25 or bristles 26, 27, 29 or by the resilient open lofty integrated web 28 of interengaged continuous crinkled filaments, or by rough indented openings, which prevents the fallen hair, hairpins or any other object, from entering and clogging the drainpipes of bathtubs, lavatories and the like. Said entangling action is reinforced by a blocking action exerted upon the fallen hair, hairpins or any other object by the circular shape of the article in all its preferred embodiments, which prevents the fallen hair, hairpins or any other object, from entering and clogging the drainpipe of bathtubs, lavatories and the like, by surrounding the entire circumference of its opening when installed around or snapped on around the lifted conventional pop-up stoppers or the like of the drain control systems, while the large enough openings of the net-like structure 3 or of the open web 28 insure the free flow of running water, and the flat imperforate base 15 or 33 contribute to a secure installation of the article in some of its preferred circular shapes, while other preferred circular shapes, which are snapped on, stay firmly in place closely in contact with the lifted stoppers.

While preferred exemplary embodiments of the invention have been illustrated and described, although not by way of limitation, it will be obvious to those skilled in the art that various changes and modifications can be made without departing from the spirit and scope of the invention and without sacrificing any of its advantages and it is intended to cover in the appended claims all such changes and modifications that are within the scope of this invention.

What I claim is:

1. An article for preventing hair and debris from entering a drain of a bathtub, shower stall, lavatory, sink and the like having a liftable stopper and a flange, said article comprising:

a unitary body shaped and dimensioned to be adapted to extend entirely around the lifted stopper periphery and to extend entirely around the external periphery of the drain generally covering the area between the drain periphery and the top of the lifted stopper periphery;

said body being of filamentary material defining openings for the free passage of water therethrough down into the drain;

a plurality of outward projections connected to said filamentary material above said opening and cooperating therewith, operable to entangle and hold hair and debris carried by water flowing through said openings.

2. The article of claim 1 wherein said body being of filamentary material is net-like defining a multiplicity of openings for the free passage of water therethrough.

3. The article of claim 2 wherein said body is a torus.

4. The article of claim 2 wherein said body is a torus truncated by a single plane which is perpendicular to an axis about which the torus is generated.

5. The article of claim 4 wherein said plane is a base.

6. The article of claim 5 having means connected to said base to attach the article to an annular area about the periphery of the drain.

7. The article of claim 6 wherein said means is pressure sensitive adhesive with a removable release layer.

8. The article of claim 6 wherein said means is a plurality of suction cups.

9. The article of claim 5 wherein said base is plain.

10. The article of claim 4 wherein said truncated torus which covers the area between the drain periphery and the top of the lifted stopper periphery has a loose fit with the lifted stopper, said truncated torus extending around the outer periphery of the flange, being the base of said truncated torus generally adjacent to the outer periphery of the flange.

11. The article of claim 4 wherein said truncated torus which covers the area between the drain periphery and the top of the lifted stopper periphery has a snapped fit with the lifted stopper and the base of said truncated torus extends over the flange.

12. The article of claim 3 wherein said torus which covers the area between the drain periphery and the top of the lifted stopper periphery has a snapped fit with the lifted stopper and rests over the flange.

13. The article of claim 3 wherein said torus is hollow cored.

14. The article of claim 4 wherein said truncated torus is hollow cored.

15. The article of claim 2 wherein said body which covers the area between the drain periphery and the top of the lifted stopper periphery is formed of a substantially vertical strip connected to an outwardly directed substantially planar base, having a central hole defined therein corresponding in size to the drain.

16. The article of claim 15 having means connected to said base to attach the article to an annular area about the periphery of the drain.

17. The article of claim 16 wherein said means is pressure sensitive adhesive with a removable release layer.

18. The article of claim 15 wherein said base is plain.

19. The article of claim 15 wherein sais base extends over the flange.

20. The article of claim 15 wherein said base extends over the flange and also extends a suitable distance over the surrounding area adjacent to the outer perimeter of the flange.

21. The article of claim 15 wherein the upper portion of said vertical strip body is bent inward and downward towards the top of the lifted conventional stopper.

22. The article of claim 2 wherein said body has a cup-like form which is shaped to be adapted to surround entirely the lifted conventional stopper extending over the top portion and also extending around the periphery of said lifted stopper, said cup-like form connected to an outwardly directed, substantially planar base, having a central hole defined therein corresponding in size to the drain.

23. The article of claim 22 having means connected to the base to attach the article to an annular area about the periphery of the drain.

24. The article of claim 23 wherein said means is pressure sensitive adhesive with a removable release layer.

25. The article of claim 22 wherein said base is plain.

26. The article of claim 22 wherein said base extends over the flange.

27. The article of claim 22 wherein said base extends over the flange and also extends a suitable distance over the surrounding area adjacent to the outer perimeter of the flange.

28. The article of claim 2 wherein said body has a stepped strip-like form which is shaped to be adapted to surround entirely the lifted conventional turnstop stopper and the like, extending over the top portion and also extending around the periphery of said lifted stopper, said stepped strip-like form connected to an outwardly directed, substantially planar base, having a central hole defined therein corresponding in size to the drain.

29. The article of claim 29 having means connected to said base to attach the article to an annular area about the periphery of the drain.

30. The article of claim 29 wherein said means is pressure sensitive adhesive with a removable release layer.

31. The article of claim 28 wherein said base is plain.

32. The article of claim 28 wherein said base extends over the flange.

33. The article of claim 28 wherein said base extends over the flange and also extends a suitable distance over the surrounding area adjacent to the outer perimeter of the flange.

34. The article of claim 1 wherein said outward projections are formed integral with said net-like body above said opening and cooperating therewith, operable to entangle and hold hair and debris carried by water flowing through said openings.

35. The article of claim 34 wherein the outward projections are configured substantially perpendicularly from a surface of the body.

36. The article of claim 34 wherein the outward projections are grouped in bundles.

37. The article of claim 36 wherein the bundles are configured as truncated cones.

38. The article of claim 34 wherein the outward projections are fan-shaped.

39. The article of claim 38 wherein the fan-shaped projections are arranged at various angles as shown for example in FIG. 21.

40. The article of claim 34 wherein the outward projections are radially arranged.

41. The article of claim 40 wherein the radial arrangement is at various angles as shown for example in FIG. 2.

42. The article of claim 34 wherein the outward projections are flexible spikes.

43. The article of claim 42 wherein the flexible spikes have burdock-like hooked tips.

44. The article of claim 34 wherein the outward projections are bristles.

45. The article of claim 34 wherein the outward projections are rough indented openings.

46. The article of claim 34 wherein the outward projections are a resilient, open web of interengaged filaments.

47. The article of claim 46 wherein said web comprises unmodified filaments.

48. The article of claim 46 wherein said web comprises modified foamed filaments.

49. The article of claim 46 wherein said web comprises modified abrasive filaments.

50. The article of claim 1 wherein said body being of filamentary material is made of a resilient web of interengaged filaments defining a multiplicity of openings for the free passage of water therethrough, down into the drain; said interengaged filaments being configured adjacent to the openings and cooperating therewith operable to entangle and hold hair and debris carried by water flowing through said openings.

51. The article of claim 50 wherein said body is a torus.

52. The article of claim 50 wherein said body is a torus truncated by a single plane which is perpendicular to an axis about which the torus is generated.

53. The article of claim 52 wherein said plane is a base.

54. The article of claim 53 having means connected to said base to attach the article to an annular area about the periphery of the drain.

55. The article of claim 15 wherein said means is pressure sensitive adhesive with a removable release layer.

56. The article of claim 54 wherein said means is a plurality of suction cups.

57. The article of claim 53 wherein said base is plain.

58. The article of claim 52 wherein said truncated torus which covers the area between the drain periphery and the top of the lifted stopper periphery has a loose fit with the lifted stopper, said truncated torus extending around the outer periphery of the flange, being the base of said truncated torus generally adjacent to the outer periphery of the flange.

59. The article of claim 52 wherein said truncated torus which covers the area between the drain periphery and the top of the lifted stopper periphery has a snapped fit with the lifted stopper and the base of said truncated torus extends over the flange.

60. The article of claim 51 wherein said torus which covers the area between the drain periphery and the top of the lifted stopper periphery has a snapped fit with the lifted stopper and rests over the flange.

61. The article of claim 51 wherein said torus is solid cored.

62. The article of claim 52 wherein said truncated torus is solid cored.

63. The article of claim 50 wherein said web comprises unmodified filaments.

64. The article of claim 50 wherein said web comprises modified foamed filaments.

65. The article of claim 50 wherein said web comprises modified abrasive filaments.

* * * * *

UNITED STATES PATENT AND TRADEMARK OFFICE

CERTIFICATE OF CORRECTION

PATENT NO. : 4,418,432

DATED : December 6, 1983

INVENTOR(S) : VIDAL, Stella Maris

It is certified that error appears in the above-identified patent and that said Letters Patent are hereby corrected as shown below:

In column 20, line 45, delete "unitary".

In column 22, line 9, "the article of claim 29" should read "the article of claim 28".

In column 22, line 63, delete "The article of claim 1 wherein" and insert in its place --An article for preventing hair and debris from entering a drain of a bathtub, shower stall, lavatory, sink and the like having a liftable stopper and a flange, said article comprising: a body shaped and dimensioned to be adapted to extend entirely around the lifted stopper periphery and to extend entirely around the external periphery of the drain generally covering the area between the drain periphery and the top of the lifted stopper periphery;--

In column 22, lines 63-64, delete "of filamentary material is"

In column 22, line 64, before "resilient" insert --three dimensional open--

In column 22, lines 67-68, delete "being configured adjacent to the openings and cooperating therewith".

In column 23, line 13, the number "15" should read "54".

Signed and Sealed this

*Fourteenth* Day of *August 1984*

[SEAL]

*Attest:*

GERALD J. MOSSINGHOFF

*Attesting Officer*

*Commissioner of Patents and Trademarks*